US006949894B1

(12) United States Patent
Sullivan et al.

(10) Patent No.: US 6,949,894 B1
(45) **Date of Patent: *Sep. 27, 2005**

(54) DIGITAL POOL LIGHT

(76) Inventors: Challen Sullivan, 4798 Valencia Dr., Delray Beach, FL (US) 33445; Kevin Doyle, 4798 Valencia Dr., Delray Beach, FL (US) 33445; Bruce Johnson, 6296 NW. 63rd Way, Parkland, FL (US) 33067

( * ) Notice: Subject to any disclaimer, the term of this patent is extended or adjusted under 35 U.S.C. 154(b) by 27 days.

This patent is subject to a terminal disclaimer.

(21) Appl. No.: 10/237,938

(22) Filed: Sep. 9, 2002

Related U.S. Application Data

(63) Continuation of application No. 10/091,899, filed on Mar. 6, 2002, now Pat. No. 6,798,154.

(60) Provisional application No. 60/324,358, filed on Sep. 24, 2001.

(51) Int. Cl.[7] ..... H05B 37/00

(52) U.S. Cl. ..... 315/362; 315/312; 362/101

(58) Field of Search ..... 362/101, 240, 362/264, 267, 246, 275; 315/312, 316, 318, 315/324, 185 R, 362, 158

(56) References Cited

U.S. PATENT DOCUMENTS 6,435,691 B1 * 8/2002 Macey et al. ..... 362/101
6,616,291 B1 * 9/2003 Love ..... 362/101
6,798,154 B1 * 9/2004 Sullivan et al. ..... 315/362

* cited by examiner

*Primary Examiner*—Wilson Lee
(74) *Attorney, Agent, or Firm*—Frank A. Lukasik

(57) ABSTRACT

The instant invention is a programmable, multi-colored, digital pool light system capable of operating multiple light sources and varying the power provided to each light bulb providing virtually unlimited amounts of light intensity, color blending and saturation. The light bulbs are mounted in a heat absorbing plate and light dispersing dichroic lenses are mounted above selected light bulbs. The program is operated by the ON/OFF switch.

11 Claims, 7 Drawing Sheets

DIGITAL POOL LIGHT

RELATED APPLICATIONS

This application is a Continuation of Provisional Patent Application Ser. No. 60/324,358, Filed Sep. 24, 2001, and patent application Ser. No. 10/091,899, Filed Mar. 6, 2002, now U.S. Pat. No. 6,798,154.

BACKGROUND OF THE INVENTION

1. Field of the Invention

The invention relates generally to pool lights and more specifically to programmable, multi-colored underwater lights.

2. Background of the Invention

A wide variety of lighting systems have been designed for use in controlling the color and intensity of lights in various applications. U.S. Pat. No. 4,317,071 to Murad discloses a computerized illumination system consisting mainly of two major subsystems, three colored lamps, and a solid state digital computer. The device was designed to have a switch arrangement to select one of a limited number of illumination "programs". The lamps are designed to illuminate the lamps in a fixed sequence, based on one of the lamps being a master to synchronize the other lamps. The rotational speed is either a fixed value or zero. This programming is done at the time of manufacture, after which it is either fixed or zero. The number of steps before a repeat of the pattern is limited to the number of light channels. The number of light channels is designed to be three, red, blue, and green. With these light colors operating in a "scattering medium", it claims to be able to produce the complete range of colors by raising or lowering the intensity of each channel. Although the reference claims mention that the blended color can be blended, this programming is done at the time of manufacture, after which it is fixed.

U.S. Pat. No. 5,041,767 to Droftei discloses a digital control for gas discharge tubes. The gas discharge tube is controlled in intensity and in the length along such tube that is illuminated by providing digital control signals to an analog drive circuit connected to the high-voltage energization device for the tube.

U.S. Pat. No. 5,406,176 to Sugden discloses a computer controlled stage lighting system having a plurality of multiple parameter lamp units each comprising means for producing a light beam having a plurality of adjustable parameters relating to beam characteristics and beam position.

U.S. Pat. No. 5,629,587 to Gray et al. discloses a programmable lighting control system for controlling illumination systems.

U.S. Pat. No. 6,031,343 to Recknagel et al. discloses a bowling center lighting system having a plurality of independently controlled light modules, each emitting light in response to an activation signal uniquely associated with the light module.

The instant invention is able to mimic the prior art in all ways and in addition distinguishes itself by incorporating the features summarized below.

SUMMARY OF THE INVENTION

The instant invention provides a programmable multi-colored underwater light comprised of a housing, multiple high intensity light bulb sources, a light dispersing lens, a water tight sealing mechanism, an electronic package including a programmable microprocessor and an electrical cord which can be wired into any 12 volt AC or higher power source. The size of the light is designed around the swimming pool industry standard underwater light niche and can be as large as 10 inches in diameter down to less than 3 inches in diameter. This light can be used in any underwater application including a swimming pool, SPA or fountain. Other sizes can also be produced depending on the application, but it should be noted that the swimming pool underwater light niche is currently installed in literally millions of existing installations. It is a key aspect of this light design that this product has the capability of retrofitting into most existing underwater light niches and can be UL approved to fully operate with any of the standard underwater light power sources including 12 volt DC and 120 volt AC.

DETAILED DESCRIPTION OF THE PREFERRED EMBODIMENT

Figure 1:
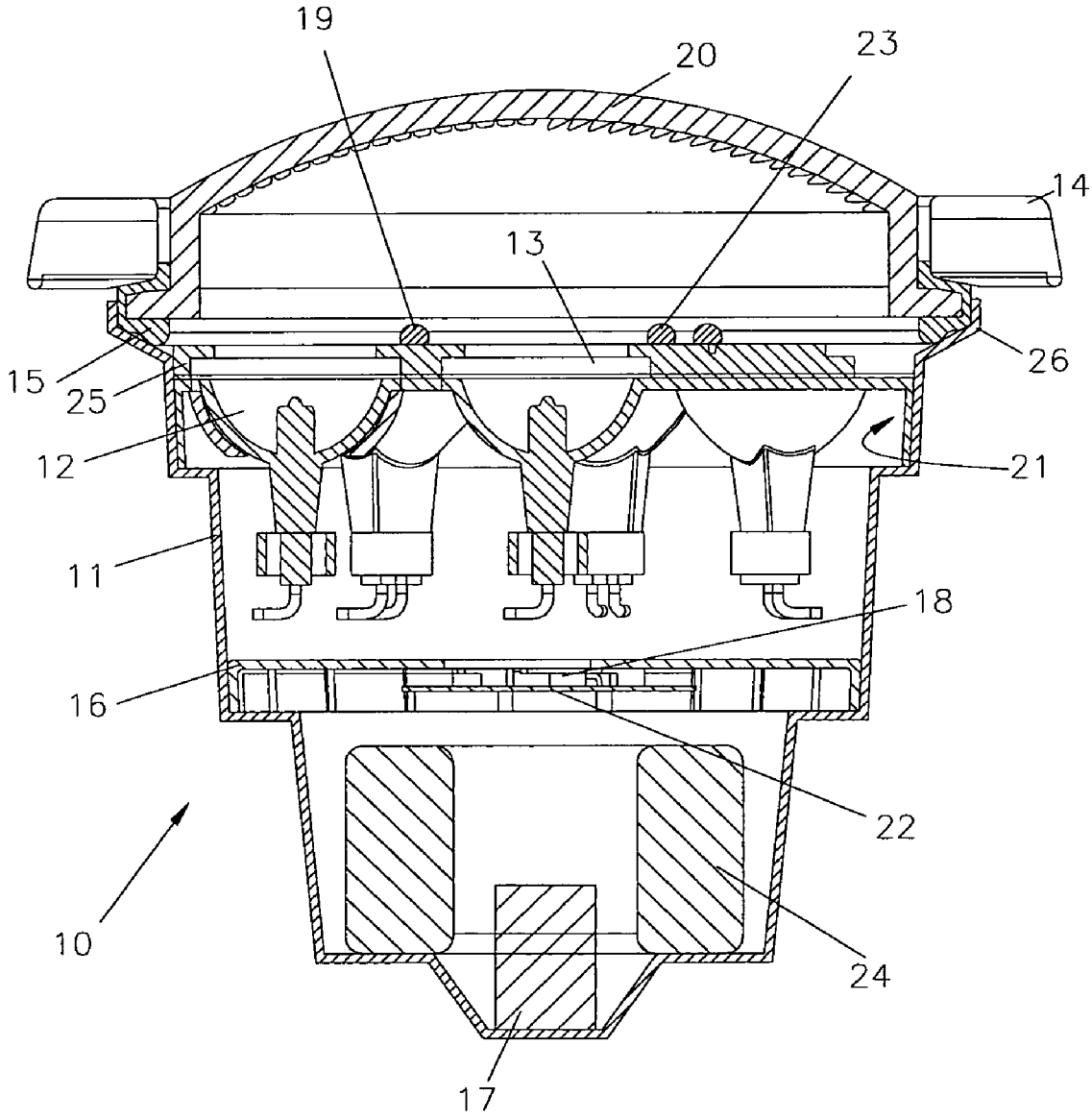
FIG. 1 is a side view, partially in section, of a digital pool light in accordance with the invention.

Referring now to the drawings wherein like numerals designate like and corresponding parts throughout the several views, in FIG. 1 the digital pool light 10 is shown in a side view, partially in section. The digital pool light 10 of the invention comprises a housing 11, multiple, high intensity light bulb sources 12, color correct, light dispersing dichroic lenses 13, a water tight sealing mechanism consisting of glass lens 20, a sealing clamp 14 and a rubber seal 15 fastened to housing 11 at the top rim 26.

The light dispersing dichroic lenses 13 "color corrects" a basic halogen light system from burning at 3050 degrees Kelvin to 3500 degrees Kelvin with minimal lumen effect. This is the first use of this type of system to "brighten" a pool without increasing the power requirement. The higher Kelvin temperature makes the light appear whiter with much less yellow in the output. In the pool it makes the light output appear significantly brighter, cleaner looking and the colors are much more saturated. The unique aspect of the invention is that it can incorporate this color enhancement either in the bulb reflector or with a separate lens. Currently there are no 75 watt color corrected halogen bulbs on the market and the unique arrangement of the invention allows a standard 75 watt halogen bulb to be used (keeping the cost of replacement low) and then adding a separate color correct lens to enhance the system.

A bulb mounting plate 25 (heat sink) is fastened to the housing 11. The bulb mounting plate 25 is shown in FIGS.

Figure 2:
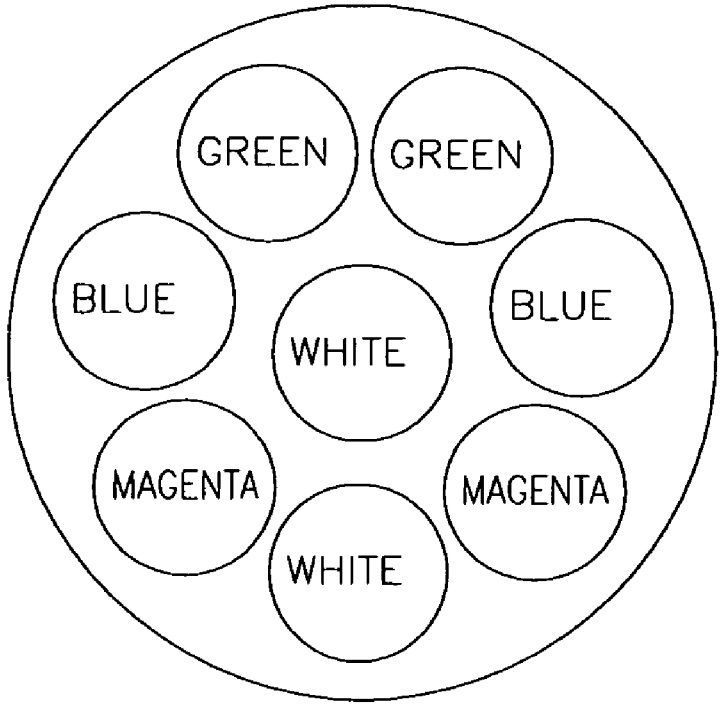
FIG. 2 is a top schematic view of a standard eight bulb layout in accordance with the invention.
Figure 3:
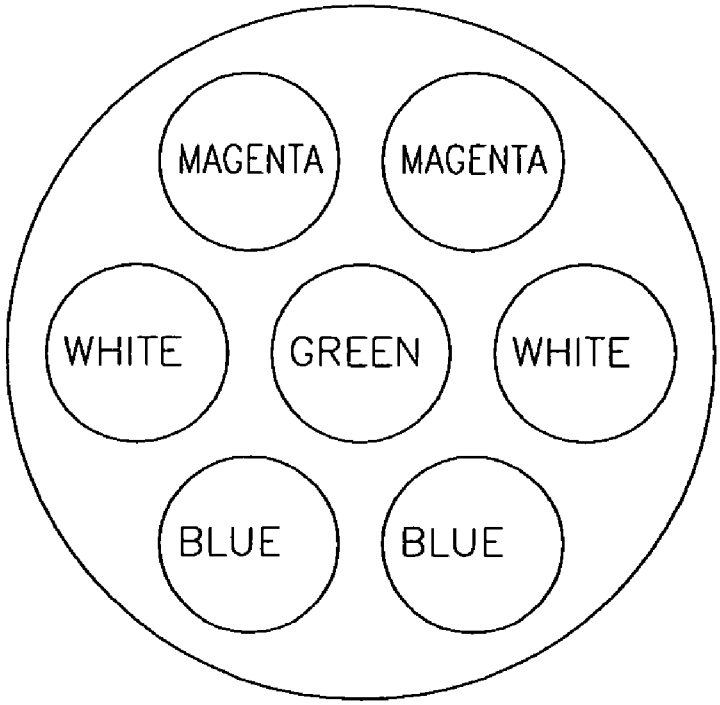
FIG. 3 is a top schematic view of a standard seven light layout in accordance with the invention.
Figure 4:
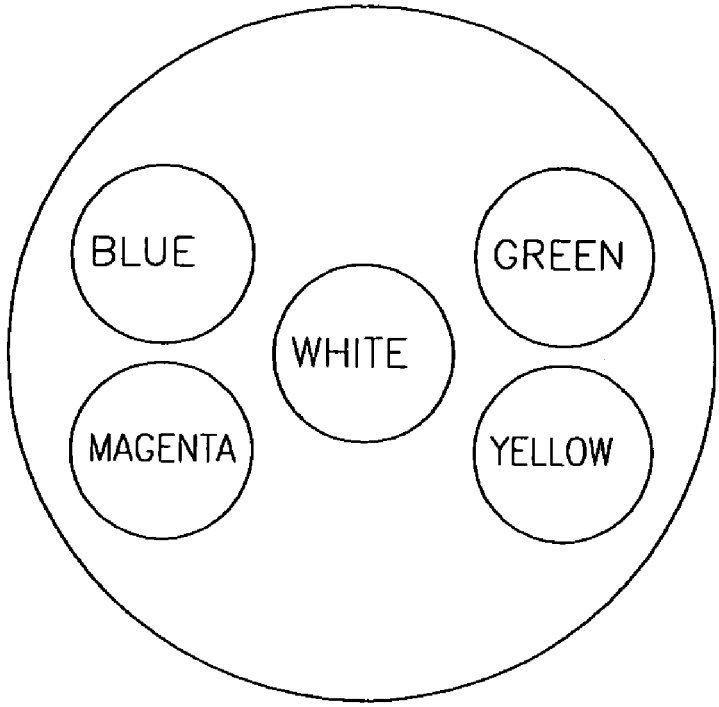
FIG. 4 is a top schematic view of a standard five light layout in accordance with the invention.
Figure 5:
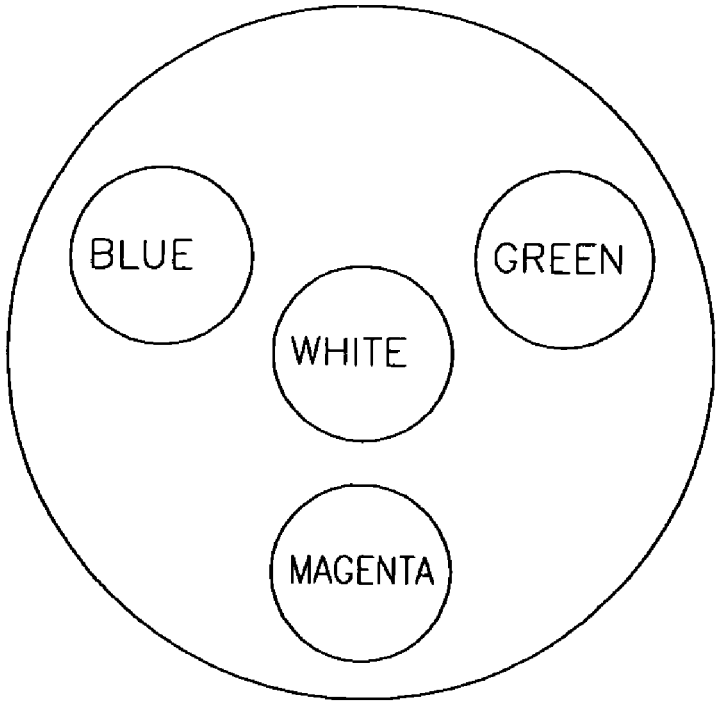
FIG. 5 is a top schematic view of a standard three light layout in accordance with the invention.
Figure 6:
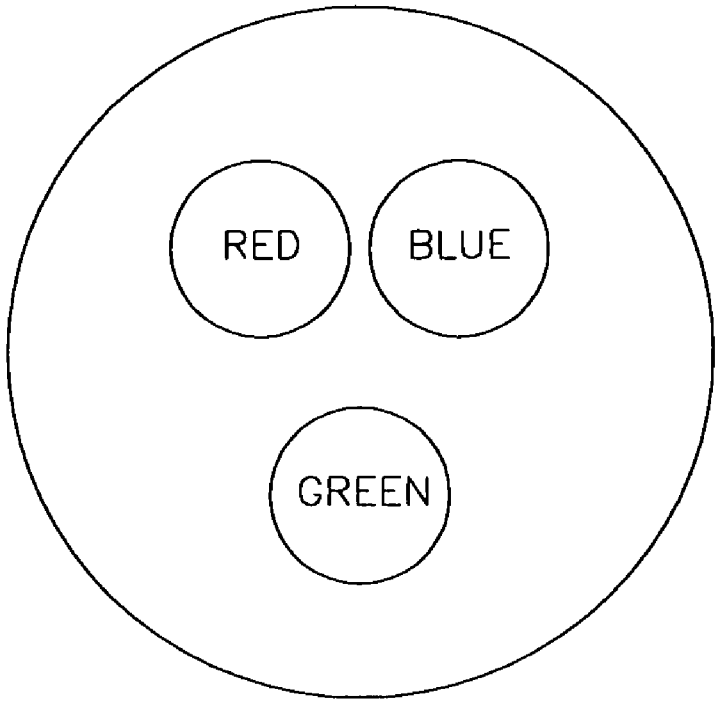
FIG. 6 is a top schematic view of a standard three light layout in accordance with the invention
Figure 7:
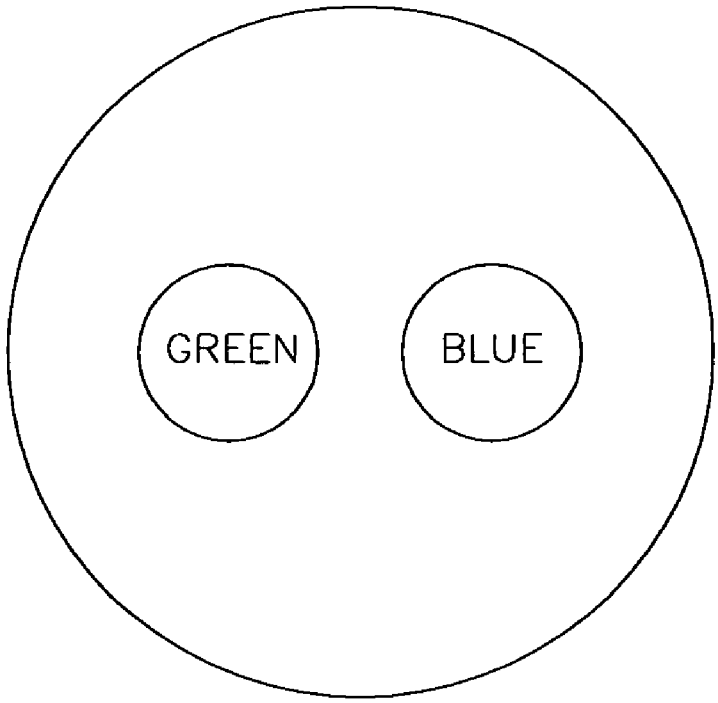
FIG. 7 is a top schematic view of a standard two light layout in accordance with the invention.
Figure 8:
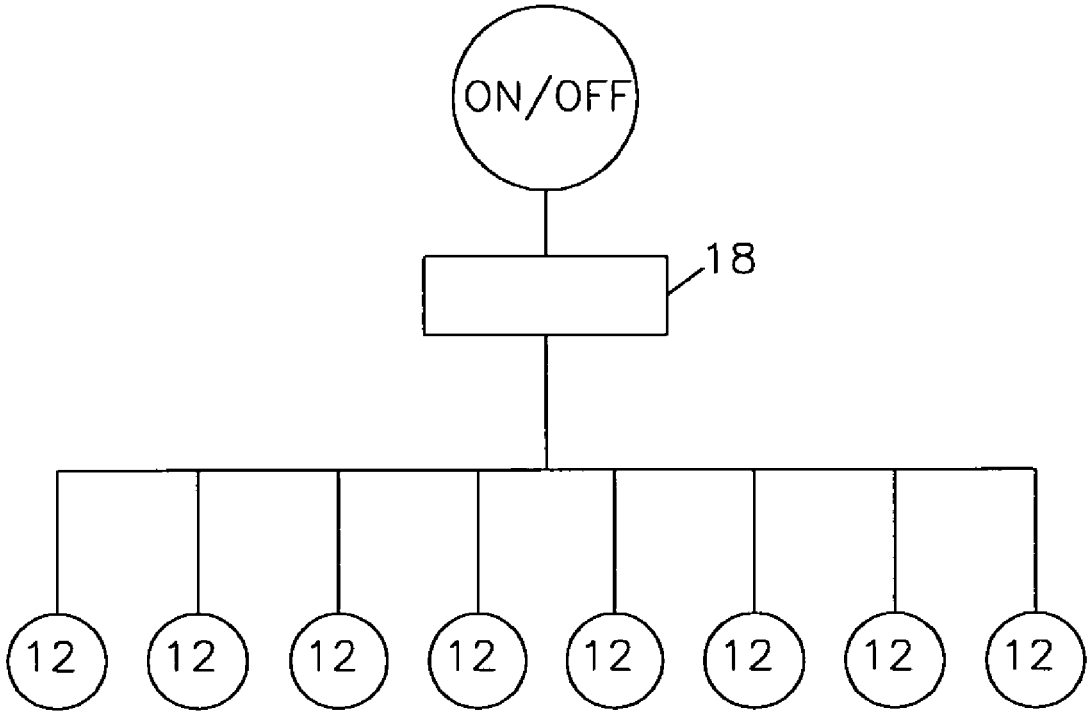
FIG. 8 illustrates the process planning of the PC board.

2–7 in the various configurations according to the number of light bulb sources 12 to be used in the application. The bulb mounting plate 25 is shown in the figures with two to eight lights. FIG. 2 shows two green, two blue, two white, and two magenta lights 12, for example. The lens 20 is a lenticular lens design, to focus and dispose-blend colors more effectively.

A preferred embodiment of the digital pool and SPA light 10 would have five bulbs 12. The number of bulbs 12 used, provide a better spread of light throughout a pool. A single bulb or single color bulb of high intensity is difficult to "spread" throughout the pool through a standard pool light fixture. This is in part due to the high intensity and in part to the "domed lens" which makes the pool light fixture waterproof. The curvature of the lens 20 restricts the ability to properly spread a single light throughout the pool without a shadow. Having at least two high intensity bulbs 12 spread out from each other allows a better, more even spread of the light throughout the pool or SPA. The lens 20 combines a "blending" capability and a "diffusing" array. This is unique and very important as the invention uses multiple pool light sources.

The advantages of multiple color light bulbs (better dispersion) are discussed above but when you have colors and color combinations, it was desired to create a lens which would blend two different colors, i.e., red and blue to make a uniform purple, then disperse the light evenly in the pool. The instant invention accomplishes the blending and dispersion of light with the lens 20 design as well as bulb positioning.

The digital light 10 operates on AC (Alternating Current) and DC (Direct Current) operated system. DC allows the electronics to run more efficiently, cooler in temperature and a lot more flexible in its options capability. DC has not been used in the pool industry for a power source other than for LED lights. The instant invention provides DC operation of high voltage bulbs-5 volts or higher.

PC board 22 is mounted with microprocessor 18, connected with a three wire power cord 68 to junction box 40. The PC board may be secured to the housing with potting material 24.

Pulse Width Modulation (PWM), used outside of the pool industry, has not been used to control an underwater pool light. PWM combined with microprocessor 18 permits microprocessor 18 to finitely control the voltage to each bulb 12. PWM allows for dimming, voltage regulation and changes in duty cycle. With PWM the bulbs 12 will be provided with a constant controlled voltage which greatly enhances the longevity of the light source and dramatically increases the consistency of the light under varying conditions.

Through the use of microprocessor 18, DC current conversion, and PWM, the instant invention virtually solves the problem of line voltage drop due to the length of the wire for 12 volt safety light systems. Wire lengths of 50 feet or more will cause a drop in voltage by as much as 30%. For most lights, this means that the output would be cut by more than double that amount or 60%. Using the unique circuitry design of the invention the problem is virtually eliminated while keeping the bulbs at a constant correct voltage and constant light output. This is a very important aspect to the light 10 of the invention. This concept may be the basis of a total low voltage conversion for the entire pool business. It provides great efficiency and safety.

Also included in the housing 11 are a sunlight sensor 19, which may be located in the housing 11 or in the junction box 40. The "sun" sensor 19 will automatically turn off the light during day light hours. This will save bulb life and energy if the light is accidentally left on all night. A "safety" motion detector 23 is incorporated into the light 10 to detect if someone or something is in the pool, a potentially tremendous safety feature. In addition an underwater speaker system 24 and transducer 17 may be mounted inside the pool light fixture that can provide sound and music into the pool.

Figure 10:
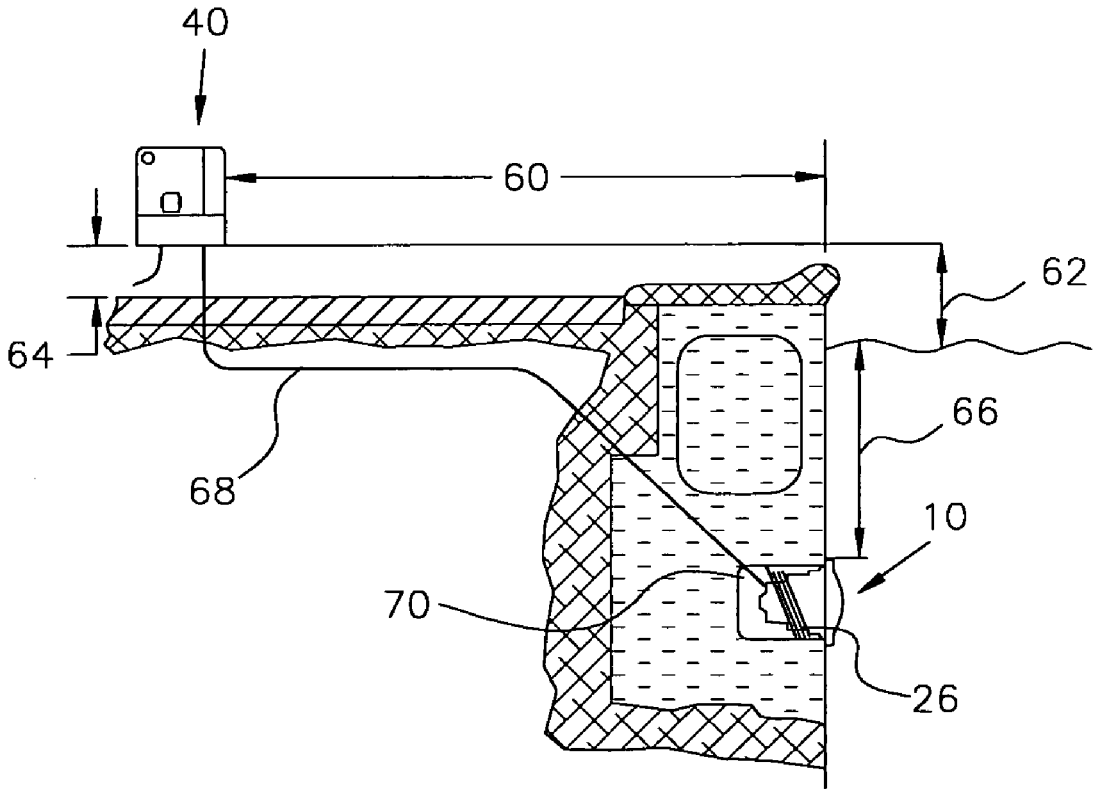
FIG. 10 is a side view, partially in section, of a pool installation.

A cover 32*a* is mounted over junction box 32. Junction box cover 32*a* houses a transformer 30 and the electronic circuits 31. Wire connector 28 is connected to the AC power supply through a GFCI circuit breaker. As shown in FIG. 10, wire connector 26 provides the power to digital pool light 10, of the invention, through rigid conduit 68 and the 4 foot of cable wrapped around light 10. No. 8 AWG ground connector bonding is located at the rear of the pool light 10 at niche 70.

Numeral 62 indicates the 8" minimum height of junction box 32, or low voltage transformer 30, above the maximum water level of the pool. Numeral 64 indicates the 4" minimum height of junction box 18 above the pool deck surface. Junction box 32 provides the transformer power for the lights 10, the sun sensor 19 and the link to outside electronics. Numeral 66 indicates the height of the water above the pool light 10.

On every pool and SPA light installation, a junction box (an electrical box that allows the pool or SPA light to be wired into the incoming power) is installed. The instant invention places a transformer 30 or power supply in the junction box 32 to convert high voltage (120–240) volts to low voltage (12–14) volts. Since virtually all junction boxes are the same size, one universal "top" for the box 32 may be retrofitted on to most existing and all new junction boxes. This means that the high voltage transformer 30 is remoted from the pool light 10. This means, for the first time, a true safety 12 VACunderwater light can be provided which can deliver constant light output without losses attributable to long runs.

Prior art color changing lights have the transformer mounted in the fixture or an a wall near the equipment. For the 120 Volt systems it means that high voltage is going to the fixture in the water. The actual power cord is submersed and although coated with a vinyl coating, if the coating is damaged or deteriorates, high voltage could go into the water-a potentially lethal situation. By remoting the transformer to the junction box 32, this problem is eliminated. The reason this has not been used in the past is that the wire loss between the junction box 32 and light 10 have caused tremendous light output losses. With the unique circuitry of the invention, the problem has been eliminated and with this invention the losses have been eliminated and combined with the transformer/junction box 32, a tremendous safety concept for all pools.

The instant invention successfully addresses the issue of providing a powerful light source capable of effectively lighting an average swimming pool, SPA or fountain with multiple color lighting options controlled by a programmable microprocessor 18. The invention uses a multi-light bulb source, lights 12, two lights or more, all housed within the limited size of a standard underwater light fixture. This design is unique in that its multi-bulb design provides a superior light output over standard lights as one or more light sources can be operated at the same time. In addition to operating multiple light sources, the programmable microprocessor 18 can vary the power provided to each light bulb thereby providing virtually unlimited amounts of light intensity, color blending and saturation. This programmable microprocessor 18 and corresponding circuitry is different from other attempts as other devices have used discreet electronic components which were not programmable. With the microprocessor 18, the programmer has complete and flexible control over all functions, which can provide much greater variety and options not possible with older technology.

The pool light 10 may be programmed and communicated with an outside source via a "line carrier system" or optionally directly wired with a two or more conductor wire. The lights 10 will be wired with a standard three wire system. With the microprocessor 18, and the unique circuit, it is possible to "communicate" with the light 10 from an outside source by sending information over the same three wires or down the optional extra two wire system. This will allow the light 10 to be reprogrammed or to send information back indicating the bulb 12 is out of pulse with music or any number of options.

Another feature of the invention is the capability of synchronizing with multiple units of lights 10. This is very important since many of the installations have more than one light installed. The instant invention is using an AC electrical wave pulse to make sure that all units are virtually the same. This circuitry is built into the light and virtually guarantees each light 10 to run the same.

Colors are produced by attaching specially built dichroic colored lens filters 13 over some of the light bulbs 12. These dichroic lenses 13 are extremely efficient, however, they are heat sensitive. Another key aspect of this invention is that the design allows multiple lower wattage bulbs to be used to create less heat, but superior light output. By combining different intensities of colors, a rainbow of color options are available. In addition, due to the programmable microprocessor 18 and corresponding electronic circuitry, no mechanical switches, relays or color wheels are required to switch between the individual light bulb sources, and virtually unlimited light and color options are available with this invention.

The preferred embodiment is limited to eight lights 12 due partially to the size of the standard pool light niche as well as the light intensity output requirement for underwater pool lights, and current bulb technology. As bulbs reduce in size and increase in light output the configuration can be changed to accommodate additional bulbs and/or additional colors may be added. The current light design uses two bulbs for each of the following four colors, white, magenta, green and blue. Many other color options are also available. By varying the number of bulbs that are operated, as well as varying the power to each bulb, the color spectrum can be dramatically changed. Other than LED technology, which cannot at this time produce the proper light intensity, the instant invention is the only light on the market which can effectively blend different primary colors into a rainbow of color output.

Other unique features include a "soft start" thermal shock protection for all of the lights 12. This effectively extends bulb life by a significant margin, a key to the overall operating efficiency of the system. Also, because the lights 12 are alternately turned on and off and because of the redundancy of the bulbs, the overall light fixture life is greatly enhanced. An enhancement designed into this fixture is the bulb mounting plate 25 which is a diecast metal plate that has been designed to channel excess heat generated by the high intensity bulbs from inside the fixture to the outer case, thereby significantly reducing the temperature inside the unit. Heat can have a detrimental effect to both the bulbs and the watertight seals used with this type of light.

Because of the soft start feature, excellent heat sink technology through the mounting plate 25 and the redundancy of bulbs, this light fixture at the current time provides the longest bulb operating time possible, based on current bulb and light intensity requirements, on the market today. Another feature of this invention is that it can be programmed with virtually an unlimited number of different lighting scripts. This allows the programmer the option of changing colors faster, varying colors, varying light output, and can even allow the capability of operating a color organ which pulses the lights to the beat of music. Prior art devices simply rotate a color wheel or index from one color to the next with limited flexibility. This invention also has the unique advantage of being able to synchronize with multiple light fixtures keeping all the colors the same for each light fixture and more importantly, from a safety standpoint, this invention will reset itself back to the brightest light color, white, upon start up. Other prior art lights, using antiquated color wheel technology, must either add special synchronizing options or the light is left in the same color as when it was turned off. A light has two purposes, one for aesthetics and the other safety. If someone or something falls into a pool or pond at night it is important to have a bright light on immediately. Only this light can provide this feature as a standard.

The instant invention includes the ability to be on 12 volt AC or higher electrical input and fully controlled with a simple wall switch or similar ON/OFF receptacle. Not only is it easy for the user, but it also allows easy retrofit capability to current installed lights.

Another key feature of this invention is the capability of making this light "smart" in that it can communicate via the microprocessor 18 with controllers outside of the fixture. Using state-of-the-art standard communication technology, the invention can provide information to the end user or service personnel such as "white light on", "red light on", "bulb is out, "light is set for 50% intensity", etc. A whole array of functions can be communicated to make this the first "smart" light on the market.

OPERATION OF THE INVENTION

Following is a summary of the operating features of the invention:

1. Fully programmable microprocessor 18 based electronic solid state system-no mechanical switches or relays;
2. Multiple bulbs, two or more with some possible combinations;
   a) Two bulbs-provide two colors or one color double the intensity,
   b) Three bulbs-provide three colors or two colors, one color can have double the intensity,
   c) Four bulbs-provide four colors or two colors with double the intensity,
   d) Five bulbs-provide either five colors or two colors (can have double the intensity),
   e) Six bulbs-provides either six colors or two colors can have double the intensity or five colors and one color has double the intensity,
   f) Seven bulbs-provide seven colors or three colors can have double the intensity and one additional color can be added or two colors can have double the intensity and two colors can be added or one color can have double the intensity and three colors can be added, g) Eight bulbs-provide either eight colors; or four colors can have double the intensity; or three colors can have double the intensity and one additional color can be added; or two colors can have double the intensity and two colors can be added; or one color can have double the intensity and three colors can be added.

More bulbs could be added, but current bulb technology does not allow this to occur due to the light intensity requirement, heat build up and size of the fixture.

Other prior art devices can provide up to four bulbs in the light fixtures but not five or more. In addition, prior art devices do not have the ability to vary the light intensity and color options as the instant invention does.

SUMMARY OF THE INVENTION

Figure 9:
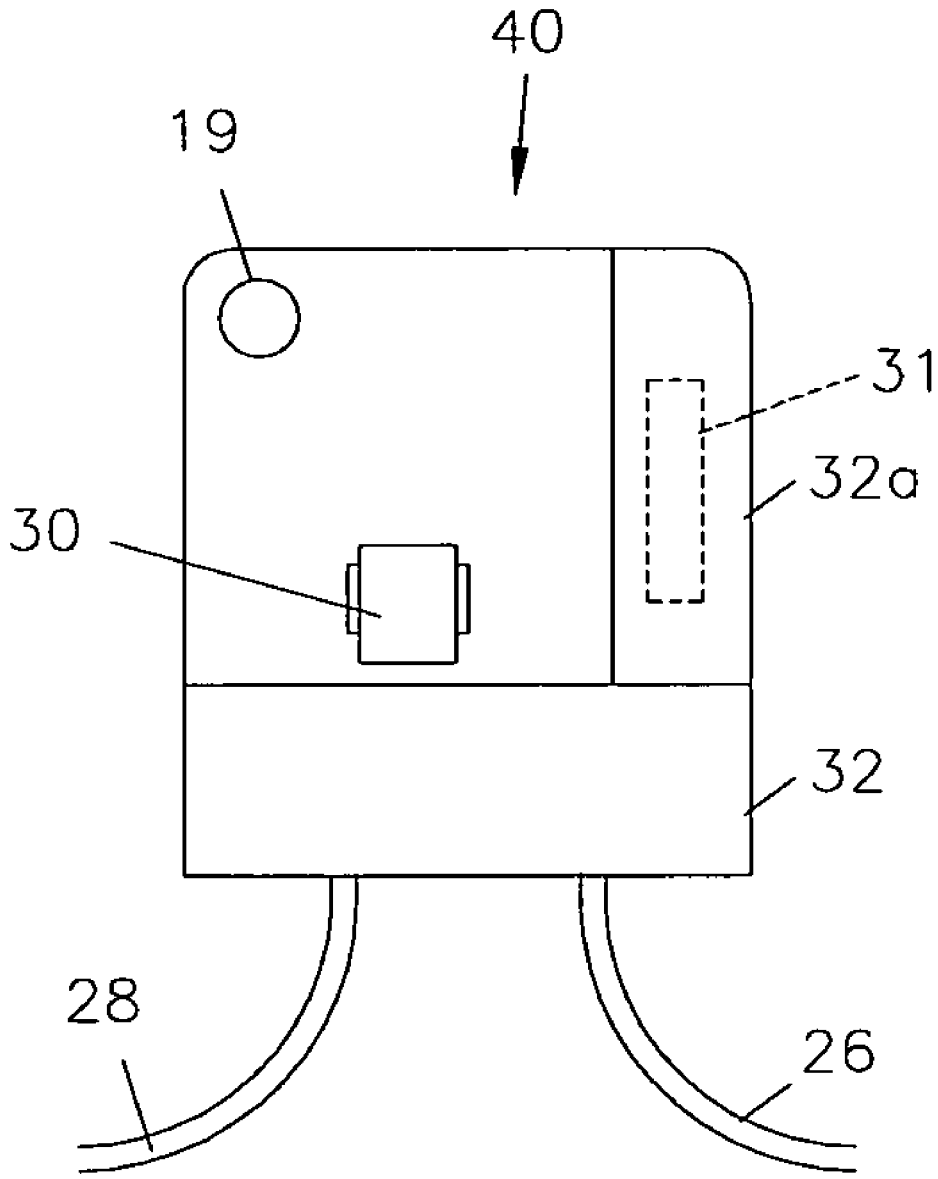
FIG. 9 is a side view of a junction box.

Following are some of the unique features of the instant invention:

a) Five bulbs or more in a fixture measuring less than nine inches in diameter. In a preferred embodiment, the lights 12 were industry standard MR16 Halogen sized bulbs or smaller.

a) Specially designed light mounting plate for maximum heat dispersion.

b) Capable of operating with either a 12 volt AC or 120 volt AC electrical input.

c) Ability to blend primary colors into a full spectrum of color.

d) Ability to provide light bulb thermal shock protection to extend bulb life.

e) Ability to operate unlimited lighting combination scripts.

f) Ability to operate unlimited lighting scripts with just one ON/OFF receptacle.

g) Ability to retrofit into most standard underwater light niches.

h) Ability to synchronize with other similar lights to keep all colors the same.

i) Ability to synchronize with other lights without the use of a separate wire.

j) Ability to operate using just three wire input.

k) Ability to reset one color for consistent operation and more importantly, safety.

l) Ability to dim different bulbs at different levels.

m) Ability to operate a color organ—pulse to the beat of music or similar stimuli.

n) Ability to be the first "smart" underwater light with full diagnostic capability, and communication capability to provide controllers or computers with all of the operating parameters of light.

o) Ability to switch selection of the program using the existing ON/OFF switch. A brief ON/OFF switch cycle allows selection of the next program. A longer ON/OFF switch cycle will cause the device to reset to the number one program. Continued brief ON/OFF cycles will select programs until rolling over to the number one program. The switch cycle program of the microprocessor 18 may be considered the electronic equivalent of a mechanical stepping switch as shown in FIG. 9.

p) The operation of the lights is truly independent, they can be made to sequentially change blend, illuminate separately, sequence uniformly, sequence non-uniformly, and sequence randomly.

q) The lights may be controlled remotely, by wire, IR, or radio link.

r) The lights may be reprogrammed remotely—in the field.

s) A sun sensor will turn off the lights if not turned off.

t) A motion detector may be provided for safety.

A significant feature of the invention is the provision of two heat sinks, mounting plate 25 for the bulb and receptacle heat and heat sink 16 for the electronics heat. This allows for an air gap between the two heat sinks and protects the electronics from being overheated as well as protecting the bulbs and watertight seals from overheating. This design eliminates the need to use a thermal potting material to reduce heat buildup.

Thus it will be appreciated that the present invention provides a novel digital pool light which can be used with most swimming pools, SPAs or other underwater applications. It is contemplated that other embodiments and/or modifications may be made in the present invention without departure from the inventive concepts manifested by the disclosed embodiments. It is expressly intended, therefore, that the foregoing description is illustrative only of preferred embodiments, not limiting, and that the true spirit and scope of the invention be determined by reference to the appended claims.

What is claimed is:

1. A programmable, multi-colored, digital pool light system capable of operating multiple light sources, using alternating current and direct current, and varying the power provided to each light bulb and thereby providing an essentially infinite spectrum of light intensity, color blending and saturation, said light system comprising:

a housing shaped to fit an existing niche in an underwater application, said housing having an upper end and a lower end, a light bulb mounting plate heat sink in direct contact to the walls of said housing allowing heat dissipation to surrounding water, said mounting plate having a plurality of light bulb retaining recesses for providing a soft start thermalshock protection, said mounting plate being mounted within said housing at said upper end, a plurality of high intensity incandescent halogen light bulbs mounted in said light bulb retaining recesses, a plurality of light dispersing dichroic tinted colored lenses mounted above selected incandescent halogen light bulbs, a printed circuit board having transistors, a programmable microprocessor means, high voltage compensation means and solid state relay system capable of controlling all the power to two or more combinations of said incandescent halogen light bulbs, a connector means for connecting said incandescent light bulbs to said microprocessor means, and a three wire power cord connected to an ON/OFF switch and said solid state relays, said line voltage regulators being directly in contact with housing walls to transfer heat through housing walls into surrounding water, and a sealing mechanism secured at said upper end of said housing, said sealing mechanism having a lenticular designed, domed glass lens, and a rubber seal, said glass lens and rubber seal being securely fastened to said housing with a sealing clamp.

2. A programmable, multi-colored, digital pool light system of claim 1 wherein said programmable microprocessor means includes a process of:

switching all the power to various incandescent halogen light bulbs, some of which are fitted with tinted primary colored lenses, blending the output of primary colors into a defined combination of color variation and output, for providing a defined number of different lighting scripts, including changing colors, varying colors, varying light output, sequencing uniformly, non-uniformly and randomly, and for pulsing the lights to the beat of music, synchronizing with multiple light fixtures keeping all the colors the same for each light fixture, resetting the lights to the brightest light color, white, upon start up, for safety and maximum light output, communicating with controllers outside of the fixture, providing information to the end user including "white light on", "red light on" and, "bulb is out", using the existing ON/OFF switch for selecting the programs, reprogramming remotely by either one of wire, IR, and radio link, and providing high voltage line compensation and exact voltage control to each Halogen bulb.

3. A programmable, multi-colored, digital pool light system of claim 1 having a junction box for providing the power to each light bulb, said junction box comprising a cover, a transformer for converting (120–240) volts alternating current to (12–14) volts direct current, electronic circuits for controlling said programmable microprocessor, and a light sensor for automatically turning off the light during day light hours.

4. A programmable, multi-colored, digital pool light system of claim 1, having a safety motion sensor for detecting the presence of a swimmer in the pool.

5. A programmable, multi-colored, digital pool light system of claim 1 having an underwater speaker system/transducer mounted inside the pool light for projecting sound and music into the pool.

6. A programmable, multi-colored, digital pool light system of claim 1 having a number of light bulbs within the range of five to eight bulbs and said light bulbs consist of standard seventy five watt color corrected halogen bulbs.

7. A programmable, multi colored, digital pool light system of claim 1 wherein said dichroic lenses color correct said light bulbs from burning at 3050 degrees Kelvin to 3500 degrees Kelvin with minimal lumen effect.

8. A programmable, multi-colored, digital pool light system of claim 1 wherein said programmable microprocessor is programmed to communicate with an outside source via a line carrier system by sending information over a standard three wire system.

9. A programmable, multi-colored, digital pool light system of claim 1 wherein each of said lights are synchronized with multiple units of said lights utilizing an electrical wave pulse to insure that all lights run virtually the same.

10. A programmable, multi-colored, digital pool light system capable of operating multiple incandescent light sources, using 120 volt/12 volt alternating current some of said incandescent light sources being fitted with tinted colored lenses, and switching the power provided to two or more combinations of said incandescent light bulbs and corresponding tinted lenses, thereby providing varying amounts of light intensity and color combinations, said light system comprising:

a housing shaped to fit an existing niche in an underwater application, said housing having an upper end and a lower end, a light bulb mounting plate sink in direct contact to walls of said housing thereby allowing heat dissipation to surrounding water, said mounting plate having a plurality of light bulb retaining recesses, said heat sink mounting plate being mounted within said housing at said upper end, a number of high intensity incandescent Halogen light bulbs within the range of five to eight light bulbs mounted in said light bulb retaining recesses, a plurality of light dispersing tinted lenses mounted above selected incandescent light bulbs, said lenses color correcting said light bulbs to various color combinations including color correcting a white Halogen incandescent light bulb from the standard 3050 degrees Kelvin up to 3500 degrees Kelvin with minimal lumen effect, a printed circuit board having transistors, a programmable microprocessor, said microprocessor being programmed to communicate with an outside source via a line carrier system by sending information over a standard three wire system, microprocessor based means with high voltage compensation means and solid state relay system capable of controlling power to multiple combinations of incandescent light bulbs, a connector means for connecting said incandescent light bulbs to said microprocessor means and said solid state relays having line voltage regulators being directly in contact with a second heat sink mounted in said lower end of said housing said sink in direct contact with housing walls to transfer heat through housing walls into surrounding water, a junction box providing power to each of said light bulbs, said junction box comprising a cover, a transformer for converting (120–240) volts alternating current to (12–14) volts alternating current, electronic circuits for controlling said programmable microprocessor, and a light sensor for automatically turning off the lights during daylight hours, a safety motion sensor for detecting the presence of a swimmer in a pool, an underwater speaker system/transducer mounted inside the pool for projecting sound and music into the pool a sealing mechanism secured at said upper end of said housing, said sealing mechanism having a lenticular designed, glass lens and a rubber seal, said glass lens and rubber seal being securely fastened to said housing with a sealing clamp.

11. A programmable, multi-colored, digital pool light system of claim 10 wherein each of said lights are synchronized with multiple units of said lights utilizing an electrical wave pulse to insure that all lights run virtually the same.

* * * * *